United States Patent [19]

Fridrich

[11] 3,974,418

[45] Aug. 10, 1976

[54] FLUORESCENT LAMP UNIT WITH BALLAST RESISTOR AND COOLING MEANS THEREFOR

[75] Inventor: Elmer G. Fridrich, Cleveland, Ohio

[73] Assignee: General Electric Company, Schenectady, N.Y.

[22] Filed: July 28, 1975

[21] Appl. No.: 599,523

[52] U.S. Cl. ..... 315/59; 240/9 A; 240/51.11 R; 315/50; 315/94; 315/100; 315/112; 315/DIG. 5; 339/52 R

[51] Int. Cl.[2] ..... H05B 41/16

[58] Field of Search ..... 315/50, 58, 59, 71, 315/94, 100, 112, 115, 246, 261, DIG. 5; 240/9 A, 51.11 R, 51.12; 339/52 R

[56] References Cited

UNITED STATES PATENTS

| | | | |
|---|---|---|---|
| 2,056,635 | 10/1936 | Wiegand | 315/58 |
| 2,087,759 | 7/1937 | Gaidies | 315/58 |
| 2,344,122 | 3/1944 | Bay et al. | 315/49 |
| 2,344,160 | 3/1944 | Meese et al. | 240/31 |
| 2,581,546 | 1/1952 | Mann | 315/100 |
| 3,436,537 | 4/1969 | Bostonian | 240/51.11 R |
| 3,714,492 | 1/1973 | Roche | 315/105 X |
| 3,753,036 | 8/1973 | Roche | 315/60 |

*Primary Examiner*—Eugene La Roche
*Attorney, Agent, or Firm*—Norman C. Fulmer; Lawrence R. Kempton; Frank L. Neuhauser

[57] ABSTRACT

An integral self-contained fluorescent lamp unit comprising an elongated lamp and an elongated ballast resistor adjacent to and alongside the lamp. Metal strip heat radiators are positioned adjacent to and alongside the ballast resistor for dissipating its heat when operating.

21 Claims, 4 Drawing Figures

FLUORESCENT LAMP UNIT WITH BALLAST RESISTOR AND COOLING MEANS THEREFOR

CROSS-REFERENCES TO RELATED APPLICATIONS

Patent application Ser. No. 599,521, John H. Campbell, filed concurrently herewith, "Fluorescent Lamp Unit for Multiple Installation", assigned the same as this invention.

Patent application Ser. No. 599,522, John M. Davenport and Elmer G. Fridrich, filed concurrently herewith, "Fluorescent Lamp Unit", assigned the same as this invention.

BACKGROUND OF THE INVENTION

The invention is in the field of gas discharge lamp units, such as fluorescent lamp units.

Gas discharge lamps, such as fluorescent lamps, comprise an elongated bulb which may be straight or curved and which contains discharge electrodes near the ends thereof and also contains a suitable gas such as mercury. A ballast must be provided for limiting the discharge current in the lamp, and "preheat" lamp circuits conventionally contain a starting switch for causing heating of the electrode filaments prior to starting of the discharge.

The above-referenced Campbell patent application discloses a compact unitary permanently assembled gas discharge lamp unit having a ballast resistor and other conductors extending alongside and adjacent to an elongated discharge lamp, and electrical connectors permanently attached to the ends of the lamp and provided with terminals so that a plurality of lamps can be connected together, end to end.

SUMMARY OF THE INVENTION

Objects of the invention are to provide an improved discharge lamp unit of the type having a ballast resistor extending alongside and adjacent to an elongated discharge lamp, and to provide a construction for such a unit that is feasible and economical to manufacture, and which has an attractive appearance.

The invention comprises, briefly and in a preferred embodiment, an elongated discharge lamp, an elongated ballast resistor positioned adjacent to and alongside the lamp, and a metal strip heat radiator positioned adjacent to and alongside the ballast resistor for dissipating heat therefrom when the lamp is operating. Preferably, the ballast resistor and heat radiator are contained in a shallow housing means extending alongside and adjacent to the lamp, one or more of the side edge regions of the housing containing the heat radiator and extending away from the lamp in the form of wings to facilitate radiation of heat from the heat radiator into surrounding space. The ballast resistor may comprise a plurality of resistors connected in electrical parallel for achieving more effective heat dissipation via the heat radiator. The heat radiator may function as a starting stripe for the lamp, and also may function as a connector for a starting switch. Alternatively, a separate starting stripe and starting switch conductor may be employed, and the heat radiator may comprise two individual heat radiator elements disposed respectively in two side wings of the plastic housing.

DESCRIPTION OF THE PREFERRED EMBODIMENTS

Figure 1:
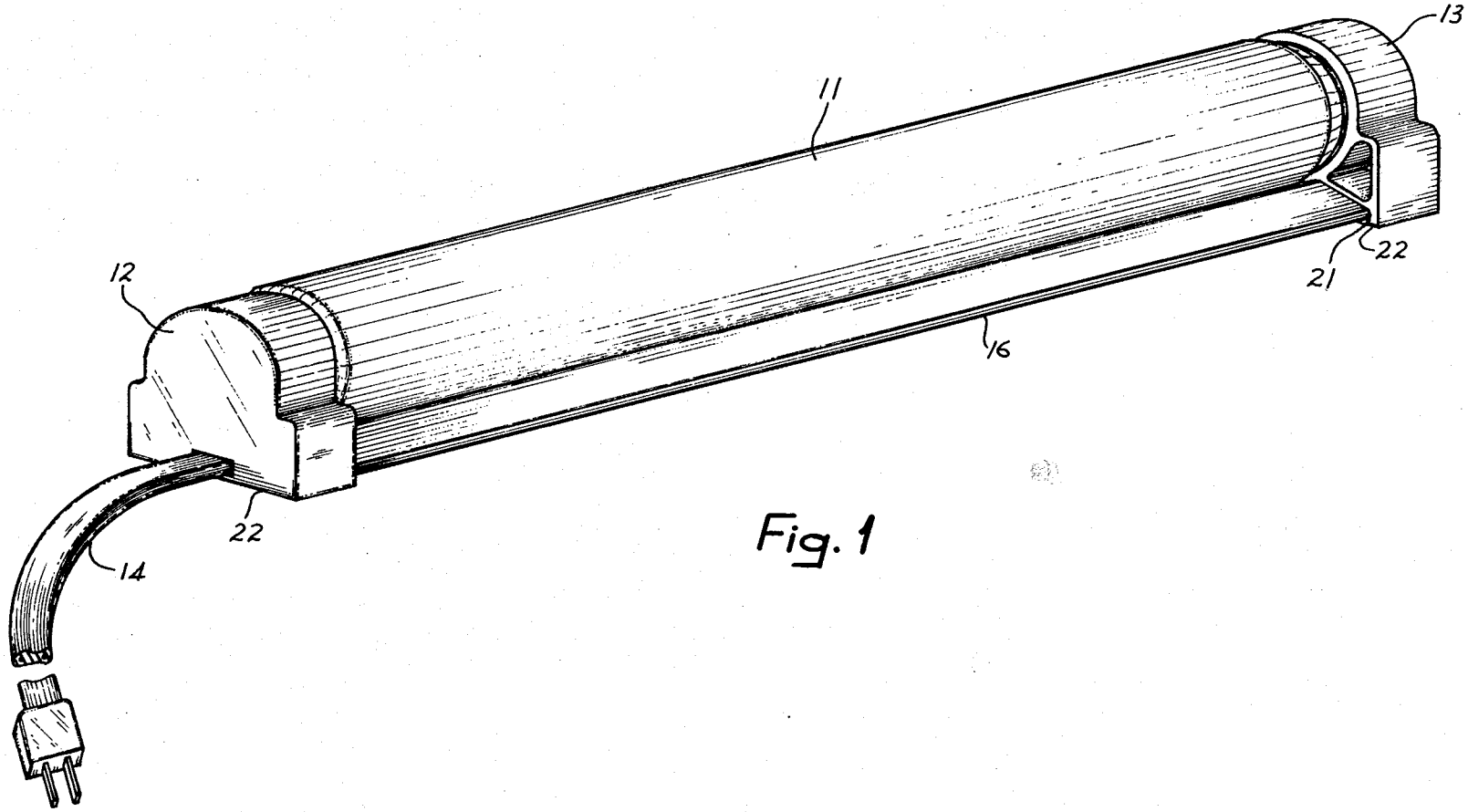
FIG. 1 is a perspective view of a fluorescent lamp discharge unit in accordance with a preferred embodiment of the invention.

In FIG. 1, an elongated gas discharge lamp 11 such as a fluorescent lamp is provided with end caps 12 and 13 permanently attached to the ends thereof. An electrical power connector cord 14 extends from one of the end caps 12. A ballast resistor and other desired conductors (which are not shown in FIG. 1) extend alongside and adjacent to the lamp 11. The arrangement thus far described is generally similar to that disclosed in the above-referenced Campbell patent application.

Figure 3:
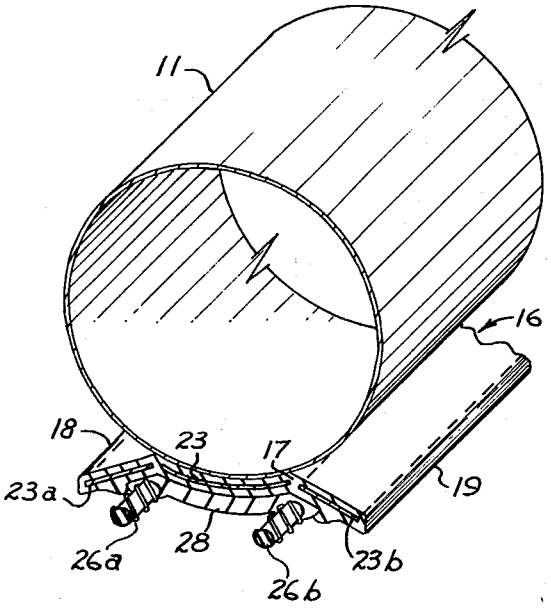
FIGS. 2 and 3 are perspective sectional views of alternative preferred embodiments of the lamp unit of FIG. 1.
Figure 2:
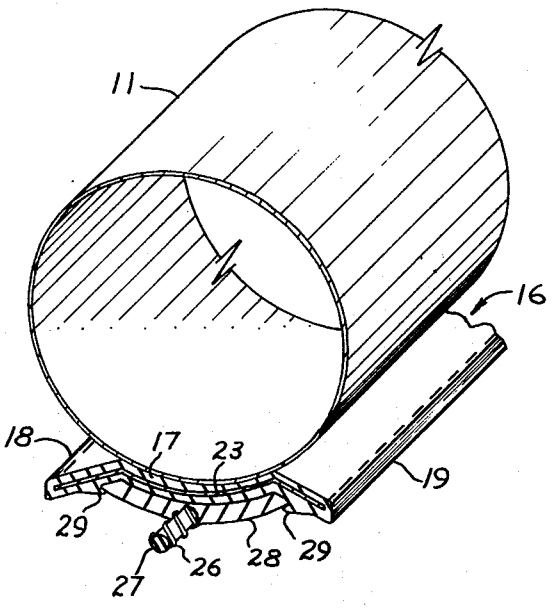

In accordance with the present invention, the ballast resistor and other conductors required for operation of the discharge lamp 11 are carried in a shallow elongated housing means or member 16 extending alongside and adjacent to the lamp 11 between the end caps 12 and 13. Preferably, the housing 16 has a central region 17 which is contoured to fit snugly against a portion of the circumference of the circular tubular bulb of the lamp 11, as shown in FIGS. 2 and 3, and the sides thereof extend away from the lamp 11 in the form of wings 18 and 19. Preferably, the ends of the housing 16 fit into slots 21 in the end caps 12 and 13, which are shaped to the cross-sectional shape of the housing 16. The end caps 12 and 13 may be adhesively or otherwise attached to the ends of the lamp 11. The ends of the housing 16 projecting into the recesses 21 of the end caps may be adhesively or otherwise attached therein, and the center region 17 of the housing 16 which is in engagement with the lamp 11 may be adhesively or otherwise attached thereto, to form a unitary permanently assembled lamp unit. Flat mounting surfaces 22 may be provided on the sides of the end caps 12 and 13, lying in a common plane extending alongside the length of the lamp 11, to function as mounting means for attaching the lamp unit to a surface. The housing 16 is positioned to be in alignment with the flat mounting surfaces 22, so that when the lamp is mounted on a surface the housing 16 will not substantially adversely affect the useful light output of the lamp unit.

In the embodiment of FIG. 2, the housing 16 contains a strip 23 of metal, such as aluminum foil, extending substantially from end to end of housing 16 and also extending laterally therein through the central region 17 and into the wings 18 and 19 to near the outer edges thereof.

The housing means 16 also contains or carries an elongated ballast resistor 26, which may comprise nichrome or other resistance wire wound helically around a plastic support 27. The ballast resistor 26 is electrically insulated from the metal strip 23 in the housing 16. In the embodiment shown, the ballast resistor 26 is carried in a separate plastic strip 28 carried on the underside of the housing 16 by means of a pair of notched ribs 29, the combination of members 16 and 28 constituting the housing means. Alternatively, the entire housing can be extruded as one piece. The metal strip 23 functions as a heat radiator for the ballast resistor 26 when the lamp is operating by conducting heat therefrom to the wings 18, 19 of the housing 16 whereupon at least some of the heat generated by the ballast resistor 26 is dissipated into surrounding air or space. If this heat were not adequately dissipated, it would increase the operating temperature of the lamp to above optimum value. The housing 16 and ballast resistor strip 28 may be made of a plastic such as "Noryl" which is sufficiently heat conductive for a sufficient amount of heat to flow from the ballast resistor 26 to the metal strip 23, and to flow from the wing portions of the metal strip through the wings of the housing so as to be dissipated into the surrounding space. At the same time, the plastic housing 16 surrounding the heat-dissipating metal strip 23 does not feel unduly hot or painful when touched by a person, and the housing 16 also electrically insulates the metal strip 23 to prevent electrical shock to a person touching it when it is connected in an electrical circuit as will be described with respect to FIG. 4. A transparent plastic such as Lexan can be used for the housing 16 and has the advantage of permitting the metal strips 23 to function as a relfector of light from the lamp. Instead of a single elongated ballast resistor element 26, two or more such elements, 26*a* and 26*b*, may be employed, as shown for example in FIGS. 3 and 4, connected electrically in parallel to constitute a ballast resistor for more effectively dissipating heat to the heat radiator 23.

In the embodiment of FIG. 3, two ballast resistors 26*a* and 26*b* are employed, and may be carried by the housing 16 in a manner as described above with respect to FIG. 2. The metal strip 23 is divided to form a first auxiliary strip 23*a* positioned in the housing wing 18 and a second auxiliary strip 23*b* positioned in the housing wing 19. The elongated ballast resistors 26*a* and 26*b* are positioned sufficiently far apart so that they can respectively dissipate heat through the plastic of the housing to the heat radiators 23*a* and 23*b*. The central conductor strip 23 can function as a starting stripe for the lamp and also as a starting switch conductor, as will be described with reference to FIG. 4.

Figure 4:
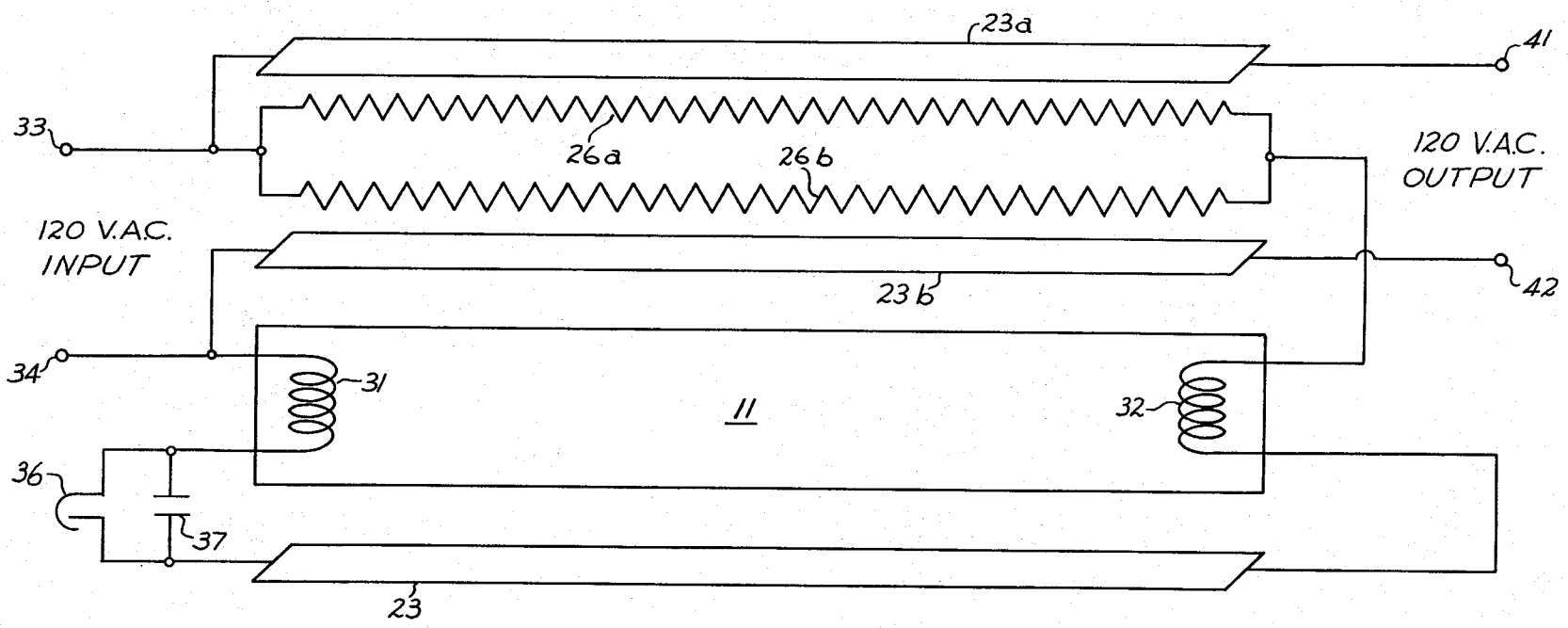
FIG. 4 is a preferred electrical schematic diagram of the lamp unit of FIG. 1.

In FIG. 4, the lamp 11 is provided with electrodes respectively near the ends thereof and conventionally comprising coiled filaments 31, 32, each coated with electron-emitting material. A pair of electrical power input terminals 33, 34 is provided, and they may be connected to or consist of a pair of wires in the connector power cord 14. The parallel-connected ballast resistors 26*a*, 26*b* are connected between the input power terminal 33 and a first end of the filament 32, and the input power terminal 34 is connected to a first end of the filament 31. The metal starting strip 23 is connected electrically in series combination with a starter switch 36, this series combination being connected between the seconds ends of the filaments 31 and 32. A capacitor 37 is conventionally connected across the starter switch 36, which may be a conventional glow-starter switch. The switch 36 and capacitor 37 may be carried in one of the end caps 12, 13.

The circuit of FIG. 4 thus far described functions as follows. When electrical power is applied to the input terminals 33 and 34, current flows between them through the ballast resistor 26*a*–26*b*, filament 32, gas in the glow switch 36, the starter conductor 23, and filament 31. The gas glow in the switch 36 generates sufficient heat to cause a bimetal contact element to close the switch 36, whereupon sufficient current passes through the filaments 31 and 32, via the ballast resistor 26*a*–26*b* and starter strip 23, to heat the filaments 31 and 32 sufficiently for them to emit electrons. After a few seconds of this preheating, the switch 36 opens and an arc discharge occurs in the lamp 11, in well-known manner. The starting of this discharge in the lamp 11, especially under high humidity conditions, is facilitated by the conductor 23, which is closely adjacent to the lamp 11, functioning as a starting stripe, in well-known manner. If the lamp 11 is a type, such as the "instant-start" type of lamp which does not require preheating of its filaments, the starter switch 36 and capacitor 37 can be eliminated, but it is desirable to incorporate the starting stripe 23, which may be electrically floating or connected to an end of one of the filaments. Thus, the metal strip 23 can function as either or both a starting stripe and a conductor for connecting the starter switch 36 into the circuit. The metal strip 23 can additionally function as a lateral heat conductor for the ballast resistor 26*a*–26*b* such as in the embodiment of FIG. 2.

FIG. 4 incorporates an additional feature of the invention, comprising a pair of electrical output power terminals 41 and 42 carried by or at the end cap 13, which are arranged for input terminals of another lamp to be connected to them, such as by plugging the lamps together, whereupon a plurality of lamps can be connected together end to end, as is disclosed in the above-referenced Campbell patent application. To accomplish this, in accordance with the present invention, the conductor strip 23*a* carried in the wing 18 of the housing 16 is connected electrically between the input power terminal 33 and the output power terminal 41, and the conductor strip 23*b* carried in wing 19 of the housing 16 is electrically connected between the input power terminal 34 and the output power terminal 42. Thus, when the power terminals 33 and 34 of end cap 12 are energized, the output power terminals 41 and 42 at the end cap 13 will be energized, so as to be capable of electrically energizing and causing operation of the next lamp unit connected thereto. The electrical connections to the ballast resistor 26 and conductors 23 can be made by welding, crimping, or other suitable means.

The invention has been found to achieve its objectives of providing a compact, slender, attractively styled discharge lamp unit with an integral ballast resistor and operating conductors of the unit electrically insulated and encased in an unobtrusive and attractive housing, which housing is provided with one or more wings to function as a heat radiator for the ballast resistor. The housing 16 can have configurations other than that shown in the drawing. For example, it can be essentially flat and wide enough so that its side regions extend sufficiently outwardly from the lamp to function as heat radiator wings. In a preferred configuration, as shown in the drawing, the central region 17 of the housing 16 is curved to conform to the tubular shape of the lamp 11, and the wings 18 and 19 are sloped in a direction away from the lamp 11 and their edges are at or near the plane of the flat mounting surfaces 22 on the end caps 12, 13.

While preferred embodiments and modifications of the invention have been shown and described, various other embodiments and modifications thereof will become apparent to persons skilled in the art and will fall within the scope of the invention as defined in the following claims.

What I claim as new and desire to secure by Letters Patent of the United States is:

1. An integral self-contained gas discharge lamp unit comprising an elongated gas discharge lamp, an elongated ballast resistor positioned adjacent to and alongside said lamp, means connecting said ballast resistor to ballast said lamp when operating, and an elongated strip heat radiator having a portion thereof extending adjacent to and alongside said ballast resistor, at least a part of the lateral dimension of said heat radiator extending away from said lamp so as to be capable of radiating heat from said ballast resistor into adjacent space.

2. A lamp unit as claimed in claim 1, including a starting switch circuit connected to aid in starting said lamp, said heat radiator being electrically connected to be an electrical conductor in said starting switch circuit.

3. A lamp unit as claimed in claim 1, including an elongated shallow housing means extending alongside and adjacent to said lamp and containing said ballast resistor and said heat radiator, said housing means being shaped so that the portion thereof containing said heat radiator extends away from said lamp.

4. A lamp unit as claimed in claim 3, including a pair of end caps attached respectively to the ends of said lamp, and means attaching the ends of said housing means to said end caps, respectively.

5. A lamp unit as claimed in claim 4, in which said means attaching the ends of the housing means to the end caps comprises slots in said end caps into which said ends of the housing means extend.

6. A lamp unit as claimed in claim 1, including an elongated shallow housing means extending alongside said lamp, and shaped across its lateral dimension so as to have an elongated central region positioned adjacent to said lamp and a pair of side regions in the form of wings extending away from said lamp, said heat radiator being contained within said housing means and extending substantially laterally thereacross in said wings and central region.

7. A lamp unit as claimed in claim 6, including a pair of end caps attached respectively to the ends of said lamp, and means attaching the ends of said housing means to said end caps, respectively.

8. A lamp unit as claimed in claim 7, in which said end caps are provided with mounting surfaces on the sides thereof and in alignment with each other along a line parallel to the axis of said lamp, said housing means being in alignment with and between said mounting surfaces.

9. A lamp unit as claimed in claim 7, including a starting switch circuit connected to aid in starting said lamp, said heat radiator being electrically connected to form an electrical conductor in said starting switch circuit, said starting switch circuit including a starting switch positioned in one of said end caps.

10. A lamp unit as claimed in claim 6, in which said lamp has a tubular shape, said central region of the housing means being curved to conform to said tubular shape of the lamp, and said wings of the housing means being sloped in a direction away from said lamp.

11. A lamp unit as claimed in claim 10, including end caps attached respectively to the ends of said lamp, said end caps being provided with flat mounting surfaces on the sides thereof, said mounting surfaces lying in a plane, and the outer edges of said wings being at or near said plane of the mounting surfaces.

12. A lamp unit as claimed in claim 1, including an elongated shallow housing means extending alongside said lamp and shaped across its lateral dimension so as to have an elongated central region positioned adjacent to said lamp and a pair of side regions in the form of wings extending away from said lamp, said heat radiator comprising a pair of elongated conductive strips respectively positioned in said wings, and said ballast resistor comprising a pair of elongated resistor units respectively positioned adjacent to said elongated strips.

13. A lamp unit as claimed in claim 12, including a center elongated conductive member positioned in said central region of the housing means and extending alongside and adjacent to said lamp.

14. A lamp unit as claimed in claim 13, including a starting switch circuit connected to aid in starting said lamp, said center conductive member being electrically connected to be an electrical conductor in said starting switch circuit.

15. A lamp unit as claimed in claim 12, including a pair of input electrical power terminals respectively connected to said heat radiator strips at one end of said lamp unit and a pair of output electrical power terminals respectively connected to said heat radiator strips at the other end of said lamp unit.

16. A lamp unit as claimed in claim 15, including a center elongated conductive member positioned in said central region of the housing means and extending alongside and adjacent to said lamp, and a starting switch circuit connected to aid in starting said lamp, said center conductive member being electrically connected to be an electrical conductor in said starting switch circuit.

17. A lamp unit as claimed in claim 12, including a pair of end caps attached respectively to the ends of said lamp, and means attaching the ends of said housing means to said end caps, respectively, said end caps being provided with flat mounting surfaces on the sides thereof and in alignment with each other and with said housing means, said wings being shaped to slope away from said lamp, the edges of said wings and said flat mounting surfaces lying substantially in a common plane.

18. A lamp unit as claimed in claim 17, including a center elongated conductive member positioned in said central region of the housing means and extending alongside and adjacent to said lamp, and a starting switch circuit connected to aid in starting said lamp, said center conductive member being electrically connected to be an electrical conductor in said starting switch circuit.

19. A lamp unit as claimed in claim 18, including a pair of input electrical power terminals respectively connected to said heat radiator strips at one end of said lamp unit and a pair of output electrical power terminals respectively connected to said heat radiator strips at the other end of said lamp unit.

20. A lamp unit as claimed in claim 6, in which said housing means is made of transparent plastic, said heat radiator being made of reflective metal.

21. A lamp unit as claimed in claim 12, in which said housing means is made of transparent plastic, said heat radiator being made of reflective metal.

* * * * *